United States Patent [19]

Pickens

[11] Patent Number: 4,590,633

[45] Date of Patent: May 27, 1986

[54] DOLL/BLANKET

[76] Inventor: Arbria E. Pickens, 301 Canyon Ridge Dr., Richardson, Tex. 75080

[21] Appl. No.: 567,906

[22] Filed: Jan. 3, 1984

[51] Int. Cl.[4] ..... A47C 31/00

[52] U.S. Cl. ..... 5/482; 5/485; 5/437; 5/413

[58] Field of Search ..... 5/413, 417, 420, 434, 5/437, 442, 482, 485, 486, 489, 490, 496; 446/71–74

[56] References Cited

U.S. PATENT DOCUMENTS

| | | | |
|---|---|---|---|
| 1,026,460 | 5/1912 | Rusk | 446/74 |
| 1,575,263 | 3/1926 | Guglienli | 446/72 |
| 2,183,418 | 12/1939 | Williams | 5/437 |
| 3,082,437 | 3/1963 | Upthagrove | 446/72 |
| 4,236,263 | 12/1980 | Allee | 5/413 |
| 4,316,287 | 2/1982 | Rule | 5/413 |
| 4,372,077 | 2/1983 | Balbuena | 446/73 |
| 4,458,372 | 7/1984 | Mills | 5/413 |

*Primary Examiner*—Kenneth J. Dorner
*Assistant Examiner*—Michael F. Trettel
*Attorney, Agent, or Firm*—Harold E. Meier

[57] ABSTRACT

A doll, and method of constructing same, including a pocket for receiving and storing bedding, such as a blanket. The doll includes a hollow conical body fashioned from one or more sheets of flexible material. The body serves as a bag or casing for containing the bedding material. Affixed to and enclosing the tapered end of the conical body comprising the casing is a doll head. A sheet of bedding material is connected to the inner surface of the casing through the open end thereof.

11 Claims, 3 Drawing Figures

DOLL/BLANKET

TECHNICAL FIELD

This invention relates to a doll/blanket and, more particularly, to an easily constructed stuffed animal or the like including a pouch for storing bedding materials.

BACKGROUND ART AND SUMMARY

There are a number of staple items which are usually present in a child's bedroom. Perhaps three of the most commonly found of such articles are pillows, blankets, and stuffed animals or dolls. In the past, these items were provided separately, resulting in additional manufacturing expenses that were ultimately borne by the purchaser. In addition, the presence of a number of such children's accessories in a crib, for example, occupies a significant amount of space which would otherwise be available for the child.

The present invention contemplates an article and method of manufacture providing a convenient and readily accessible means for storing bedding materials which will also serve as a doll, stuffed animal or pillow. Simply stated, the invention comprises a casing or body portion which serves as a pocket for receiving bedding material, such as a blanket. The blanket is affixed to the casing or body portion, and may be folded and placed therein for storage. When the blanket is being stored, the blanket acts as stuffing material to fill out the casing or body portion in the same manner as the stuffing of a pillow, stuffed animal or doll. When shaped properly, the casing can serve as a pillow when the blanket is stored therein. Further, a properly shaped casing with appropriate embellishments, such as a head, arms and legs will become a stuffed animal or doll when storing bedding material.

More specifically, the present invention comprises a doll including a pocket for receiving and storing bedding, such as a blanket. The doll includes a hollow conical body fashioned from one or more sheets of flexible material. The body serves as a bag or casing for containing the bedding material. Affixed to and enclosing the tapered end of the conical body comprising the casing is a doll head. A sheet of bedding material is connected to the inner surface of the casing through the open end thereof.

According to more specific aspects of the invention, the doll body includes at least two panels of flexible material. The bedding material comprises a rectangular blanket which is connected to the doll body at a corner thereof. A predetermined length of the edges of the blanket's corner are aligned with and are secured between the edges of the doll body panels. At least two strips of VELCRO fastening material are provided on the inner surface of one of the body panels adjacent to the lower end thereof. The VELCRO strips are utilized to secure the blanket within the doll body.

The present invention also contemplates a method of constructing a doll, which is capable of containing and dispensing bedding. The method includes securing åt least two strips of fastening material to the inner face of a front skirt panel adjacent to the lower edge thereof. The upper edge of the front skirt panel is gathered together and secured to the bottom edge of the doll head. The upper edge of a back skirt panel is gathered together and is also secured to the bottom edge of the doll head. A corner of a rectangular sheet of bedding is placed between the inner faces of the front and back skirt panels. The side edges of the front and back panels are aligned with the edges of the corner of the sheet of bedding material placed therebetween. The aligned edges of the front skirt panel, the back skirt panel and the sheet of bedding are then secured together.

A number of advantages are provided by the present invention. One advantage deriving from the use of the present invention is the ability to provide a readily accessable means for storing bedding material. Another advantage deriving from the use of the present invention is the ability to protect a stored blanket from spills, wear, etc. Yet another advantage deriving from the use of the present invention is the ability to provide a single article which can be used as either bedding material or, in the alternative, as a doll or pillow. Still another advantage deriving from the use of the present invention is the ability to provide a single article which may be used as bedding material or, alternatively, as a doll or a pillow, but which is less expensive to manufacture than the combination of articles which it replaces.

Another advantage of this invention is that the doll/-blanket is easily washed, unlike conventional stuffed toys which are difficult if not impossible to wash.

DETAILED DESCRIPTION

Figure 1:
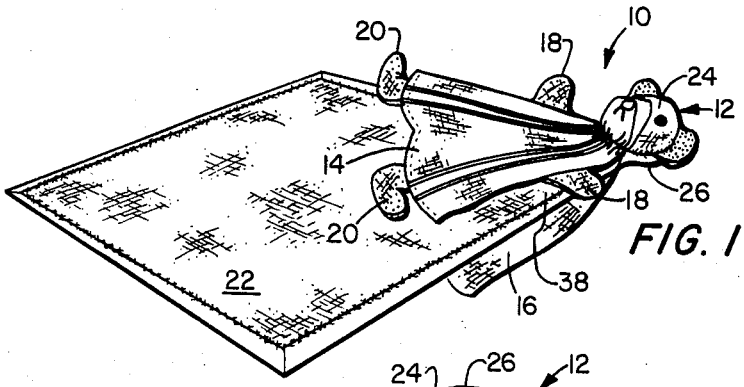
FIG. 1 is an exploded perspective view of a preferred embodiment of the invention.

Referring now to the drawings, wherein identical components are identified by the same reference numeral throughout the FIGURES, FIG. 1 shows a partially assembled doll 10. The doll 10 includes a head 12 formed in the likeness of the well known teddy bear. Affixed to and extending from the bottom of the head 12 are front and back skirt panels 14 and 16, respectively. Skirt panel 14 is embellished with a pair of arms 18, which extend laterally outward from the front skirt panel 14, and a pair of feet 20, which extend downwardly from the bottom of the panel 14. The skirt panels 14 and 16 are splayed apart in FIG. 1 to illustrate the relative positioning of a conventional blanket 22.

Figure 2:
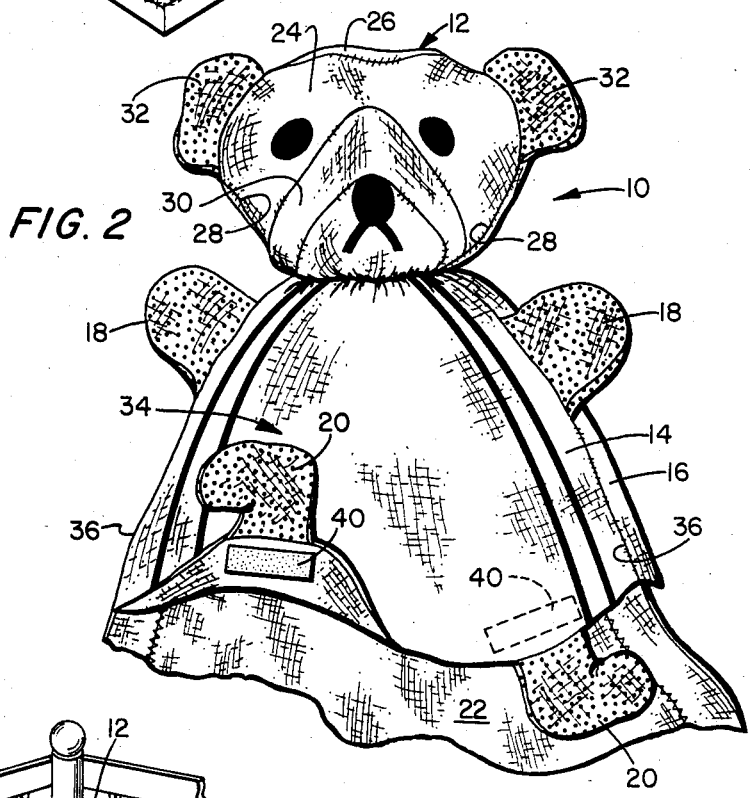
FIG. 2 is a partial frontal view of a preferred embodiment of the invention wherein the bedding material is unfolded and extended.

The construction of the doll 10 is shown in greater detail by FIG. 2. Specifically, the head 12 of the doll 10 comprises a front head portion 24 and a back head portion 26 which are secured together by stitching along their peripheries, forming a seam 28. The head portions 24 and 26 are each constructed from two layers of fabric material with a layer of padding therebetween. The utilization of padding between two layers of fabric material gives the doll head 12 a resilient shape without requiring the use of stuffing material within the head 12. Accordingly, the head 12 is hollow, and retains its shape from the incorporation of padding in the construction thereof.

The head 12 includes various embellishments giving the doll 10 the likeness of the well-known teddy bear character. For example, the front head portion 24 includes a snout 30 and a pair of ears 32. The snout 30 and ears 32 are constructed, as is the entire head 10, from two layers of a fabric material sewn together with a layer of padding therebetween.

It will be apparent that various alternative methods and means can be utilized in the construction of the head 12. For example, any flexible material, such as plastic sheet, could substitute for the fabric material used to construct the doll head 12. In such case, the head portions 24 and 26 could be secured together thermally along seam 28. In addition, as an alternative to stitching, thermally and/or pressure sensitive adhesive could be utilized in the construction of the doll head 12. Further, it will be apparent that the head 12 may be constructed in virtually any likeness.

Affixed to the bottom of the head 12, and extending downwardly therefrom, is a skirt or body 34. The skirt 34 comprises front and rear skirt panels 14 and 16, which are secured together along the edges thereof by stitching, forming a pair of seams 36. Although the skirt panels 14 and 16 of the preferred embodiment are made of cloth or fabric material, any flexible material, such as plastic sheet, will suffice. In addition, it will be apparent that any of the well known methods and means discussed above with reference to the construction of the doll head 12 may be utilized to secure together the edges of the skirt panels 14 and 16, and to secure the upper edge of the skirt 34 to the bottom of the doll's head 12.

The skirt 34 is preferably conically shaped to receive a corner of the rectangular blanket 22, as shown in FIGS. 1 and 2. The front and back skirt panels are substantially identically shaped, having side edges that converge towards the doll head at approximately a 90 degree angle. However, the side edges of the skirt panels 14 and 16 do not converge completely, but leave an upper edge which may be used to secure each panel to the bottom of the doll head 12. The upper edge of each of the skirt panels 14 and 16 is preferably wider than the bottom of the doll head 12, and must therefore be gathered together when secured to the head 12. This effectively increases the volume of the skirt 34.

The construction of the skirt 34 of doll 10, and its connection to the blanket 22, is more readily understood from the illustration of FIG. 1. The gathered upper edge of the front skirt panel 14 is secured to the front portion 24 of the head 12. In similar fashion, the gathered upper edge of the back skirt panel 16 is secured to the bottom edge of the back portion 26 of the head 12. The front and back head portions 24 and 26 are preferably not secured together along the edges to which the respective front and back skirt panels 14 and 16 are secured. This leaves an opening (not shown) leading into the hollow doll head 12. As will be discussed, this opening in the bottom of the doll head 12 facilitates connection of the blanket 22 to the doll 10.

A corner 38 of the rectangular blanket 22 is positioned between the inner faces of the front and back skirt panels 14 and 16. The side edges of the blanket corner 38 are aligned with the side edges of the front and back skirt panels 14 and 16, as shown in the exploded view of FIG. 1. When construction of the doll 10 is completed, the side edges of the blanket corner 38 are secured between the side edges of the front and back skirt panels along seams 36 (shown in FIG. 2). It will be apparent that any of the previously discussed alternative methods and means of constructing the doll head 12 may be applied to secure the edges of the blanket corner 38 to the skirt along the seams 36 of the skirt.

Since the side edges of the front and back skirt panels 14 and 16 do not converge completely, the tip of the blanket corner 38 will remain unsecured to the doll skirt 34. This tip can be inserted through the previously mentioned opening in the bottom of the doll head 12, if desired. In the alternative, the tip of the blanket corner 38 can be folded over and secured between the blanket corner 38 and the inner face of the back skirt panel by tacking or other appropriate means. The blanket 22 is further secured to the skirt 34 by stitching; however, any other suitable methods or means discussed herein may be utilized to secure the blanket corner 38 to the back skirt panel 16.

Referring now to FIG. 2, the front skirt panel 14 includes a number of appendages, specifically arms 18 and feet 20, which extend therefrom. These appendages may be constructed and affixed to the front skirt panel 16 in similar fashion to the construction and attachment of the ears 32 on the doll head 12. The front skirt panel 14 includes a sheet of padding secured between two layers of fabric, or other similar material. The sheet of padding stiffens the skirt 34, thereby enhancing the overall appearance of the doll 10.

The front skirt panel 14 also includes a pair of fastening strips 40 for securing the blanket 22 within the doll skirt 34. The fastening strips 40 are preferably made of male VELCRO fastening material, which is capable of engaging the surface of the blanket 22. In the alternative, the fastening strips 40 may comprise any type of material, such as adhesive material, which will adhere to the surface of the blanket 22.

Figure 3:
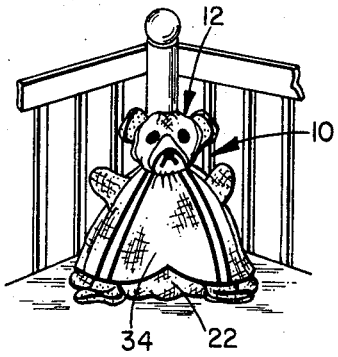
FIG. 3 is a frontal view of a preferred embodiment of the invention wherein the bedding material is folded and is stored therein.

FIG. 3 illustrates the doll 10 with the blanket 22 stored therein. The blanket 22 is folded into the skirt 34 of the doll 10. Following placement of the blanket 22 within the skirt 34, the fastening strips 40 are applied to the exposed surface of the blanket 22, thus securing the bottom edge of the front skirt panel 14 against the blanket 22. Since the blanket is then secured to both the front and back skirt panels 14 and 16, the blanket is effectively held within the doll 10.

It will be apparent that the present invention can be embodied in a number of forms. For example, virtually any type of figure can be fashioned which embodies the concept of this invention, including virtually any animal, person or object. Moreover, the concept of this invention may be embodied in a casing having a blanket or other bedding connected thereto, which will serve as a pillow when the bedding is stored therein.

To assemble each of the arms 18, feet 20 and ears 32 of the doll 10, two pieces of fabric and one piece of padding must be cut in the appropriate pattern. The edges of the pieces of fabric and the piece of padding are aligned with the fabric pieces adjacent each other. All but one of the aligned edges is secured together by stitching, or by other suitable alternative means or methods. The sewn piece is then turned inside out through the open edge.

A similar procedure is used to construct the front skirt panel 14, if it is desired that the panel include padding. In such case, the bottom edge of the skirt panel 14 would remain open. After construction of the front skirt panel is completed, the arms 18 and feet 20 are attached thereto by stitching, or other suitable means or methods.

To assemble the front and back head portions 24 and 26, two pieces of fabric material and one piece of padding are cut in the appropriate pattern. The edges of the pieces of fabric material and padding are aligned and are then secured together with the piece of padding disposed between the pieces of fabric. The ears 32 are then secured to the front head portion 24 by stitching or other appropriate means or methods.

The front and back skirt panels 14 and 16 are then secured to the front and back head portions 24 and 26, respectively. The upper edge of each skirt panel 14 and 16 is gathered to fit the bottom edge of the respective front and back head portions 24 and 26. The now gathered upper edge of the front skirt panel 14 is secured to the bottom edge of the front head portion 24 by stitching or other suitable means or methods. The same procedure is followed to secure the upper edge of the rear skirt panel 16 to the bottom edge of the back head portion 26.

The corner 38 of the blanket 22 is then secured between the front and rear skirt panels 14 and 16. The front skirt panel 14 is positioned with the outer face thereof facing upwardly. The back skirt panel 16 is then placed on top of the front skirt panel 14 with the outer face of the panel 16 adjacent the outer face of the panel 14. The side edges of the front and back skirt panels 14 and 16 are then aligned. The corner 38 of the blanket 22 is next placed on top of the rear skirt panel 16 with its edges in alignment with the side edges of the underlying skirt panels. The aligned edges of the front and back skirt panels 14 and 16 and the blanket corner 38 are thereafter secured together by stitching, or other suitable means or methods. The edges of the front and back head portions 24 and 26, which at this point are inside out, are secured together about their peripheries. However, the head portions 14 and 16 are not secured together where they are connected to the skirt panels 14 and 16. The entire doll is then turned inside out through the relatively wider bottom end of the doll skirt 34.

The blanket 22 is then further secured to the doll 10. The blanket corner 38 is secured to the back skirt panel 16 by stitching, or other appropriate means or methods. The tip of the blanket corner 36, which at this point remains unsecured to the doll 10, may be inserted into the hollow head 24 of the doll 10 through the opening in the bottom of the head. Alternatively, the tip may be folded over and secured to the surface of the blanket corner 34 by stitching, or other suitable means.

Two strips 40 of fastening material are secured to the inner face of the front skirt panel 14, preferably one-half inch above the bottom edge thereof. The fastening strips 40 may be secured to the front skirt panel 14 by stitching or other appropriate means.

Although only a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A doll including a receptacle for receiving and storing bedding comprising:

a hollow conical body, fashioned from a plurality of panels of flexible material, for storing one or more sheets of flexible material therein;

a head affixed to and closing the tapered end of said conical body; and one or more sheets of flexible material connected to the inner surface of said conical body, wherein said sheets of flexible material are rectangular and wherein a corner of each of said sheets is connected to a portion of the inner surface of said conical body, said sheets of flexible material having a surface area several times larger than the surface area of the panels of flexible material for folding and storing in the conical body.

2. A doll according to claim 1 wherein said sheets of flexible material connected to said body comprises bedding.

3. A doll according to claim 1 wherein said sheets of flexible material are connected adjacent the periphery thereof to a portion of the inner surface of said body.

4. A doll according to claim 3 further comprising means disposed adjacent the wider end of said conical body for releasably securing said sheets of flexible material within said body.

5. A doll according to claim 4 wherein said securing means includes a plurality of fastening strips which are capable of adhering to said sheets of flexible material.

6. A doll including a receptacle for containing and storing bedding comprising:

a head fashioned from flexible material;

a skirt including at least two sheets of flexible material secured together along the edges thereof, said skirt having an open upper end secured about its periphery to the bottom of said head and having an open lower end having a perimeter which is substantially greater than the perimeter of the upper end of said skirt;

a rectangular sheet of bedding secured to the inner surface of said skirt, said bedding material having a surface area which is substantially greater than each of said sheets of flexible material so that said bedding material can be folded and stored in said skirt;

wherein said head is hollow and includes an opening in the bottom thereof, the periphery of which is secured to the periphery of the upper end of said skirt; and wherein said skirt includes first and second panels, each having substantially identical shapes and wherein a predetermined portion of the edges of the corner of said sheet of bedding are aligned with and are secured between the edges of said first and second panels.

7. The doll according to claim 6 wherein the adjacent surfaces of said second panel and said sheet of bedding are secured together.

8. The doll according to claim 7 wherein the tip of the corner of said sheet of bedding extends through the open upper end of said body portion and into said head.

9. The doll according to claim 8 wherein said sheet of bedding material is a blanket.

10. The doll according to claim 6 wherein the tip of the corner of said sheet of bedding is folded and secured between the surfaces of the sheet of bedding and the second panel.

11. The doll according to claim 6 further comprising means for releasably securing the bottom of said first body sheet to said sheet of bedding.

* * * * *